US006981443B2

(12) United States Patent
Tillaart

(10) Patent No.: US 6,981,443 B2
(45) Date of Patent: Jan. 3, 2006

(54) TREE TYER

(75) Inventor: Marlin Tillaart, Brougham (CA)

(73) Assignee: Dutchmaster Nurseries Ltd., Ontario (CA)

( * ) Notice: Subject to any disclaimer, the term of this patent is extended or adjusted under 35 U.S.C. 154(b) by 85 days.

(21) Appl. No.: 10/622,828

(22) Filed: Jul. 21, 2003

(65) Prior Publication Data

US 2005/0022678 A1 Feb. 3, 2005

Related U.S. Application Data

(60) Provisional application No. 60/396,711, filed on Jul. 19, 2002.

(51) Int. Cl.
*B65B 13/10* (2006.01)

(52) U.S. Cl. ..... 100/9; 100/13; 100/27; 47/1.01 R; 47/44

(58) Field of Classification Search ..... 100/8, 100/9, 13, 25, 26, 27; 47/1.01 R, 42, 44, 47/45, 47; 24/36, 265 AL; 70/18, 40, 48; 254/133 R, DIG. 14; 269/130, 131; 248/218.4, 248/227.3, 228.5, 230.5; 53/588
See application file for complete search history.

(56) References Cited

U.S. PATENT DOCUMENTS

| | | | | |
|---|---|---|---|---|
| 1,150,999 | A * | 8/1915 | Corley | 70/211 |
| 1,388,691 | A * | 8/1921 | Bergen | 70/25 |
| 1,399,207 | A * | 12/1921 | Goozey | 24/598.3 |
| 4,939,989 | A | 7/1990 | Zacharias | |
| D332,043 | S * | 12/1992 | Linhart | D8/333 |
| 5,590,592 | A | 1/1997 | Irvin | |
| 6,666,133 | B2 * | 12/2003 | Squyres | 100/13 |
| 6,786,026 | B2 * | 9/2004 | Helmrich | 53/589 |

OTHER PUBLICATIONS

"Standing Tree Baler", Caretree Systems (2 pages).
"Standing Tree Tier Tree Baler", Tree Equipment Design, Inc. (2 pages).

* cited by examiner

*Primary Examiner*—Derris H. Banks
*Assistant Examiner*—Jimmy T. Nguyen
(74) *Attorney, Agent, or Firm*—Dinesh Agarwal, P.C.

(57) ABSTRACT

Apparatus for engaging and folding the limbs of a tree in a tree baling apparatus features opening and closing by means of concentric part circular tubes of a frame. When gaps of the nested tubes are in alignment, a tree trunk can be received within the frame then closed in by rotating the gaps out of alignment. The closed ring, horizontally engaged about a tree, is then drawn upwardly deflecting the limbs of the tree into a folded configuration for tying. No pivot arms are used as in conventional equipment, avoiding the problems of wear and distortion at pivot linkages.

2 Claims, 1 Drawing Sheet

TREE TYER

This application claims priority based on U.S. provisional patent application No. 60/396,711 filed on Jul. 19, 2002, which is incorporated herein by reference.

BACKGROUND OF THE INVENTION

Commercial tree nurseries regularly employ one or other version of "standing baler" apparatus for folding and tying tree limbs for shipping and handling nursery stock. Such apparatus includes means for upwardly deflecting the limbs of a tree while simultaneously spirally tying the tree limbs in a compact bale.

One example is given in U.S. Pat. No. 4,939,989 (Zacharias), which discloses a tree limb folding apparatus which has a base adapted for mounting from an elevatable support (e.g. forklift). That tree limb folding and tying apparatus includes a generally annular horizontal frame operable to receive a lower trunk portion of the tree. The frame includes at least two peripherally adjacent arcuate frame sections which can be pivotally shifted relative to each other between closed and open positions. When open, there is defined a passageway between adjacent ends of the frame sections through which to receive the bole of a tree upon advancing the open frame toward the tree. Once the apparatus is horizontally engaged about a tree, it can be drawn upwardly, deflecting the limbs of the tree into a folded configuration, ready for tying.

A significant problem arises with standing tree balers that employ pivoting gates or arms to embrace the lower trunk of the tree and then to be drawn upward along the branches, as these mechanisms are vulnerable to distortion at and around the pivot.

SUMMARY OF THE INVENTION

It is an object of my invention to provide a limb engaging and folding apparatus for a tree tyer (baling apparatus) which is simpler in construction and sturdier in operation than existing such devices.

DESCRIPTION OF PREFERRED EMBODIMENT

Figure 1A:
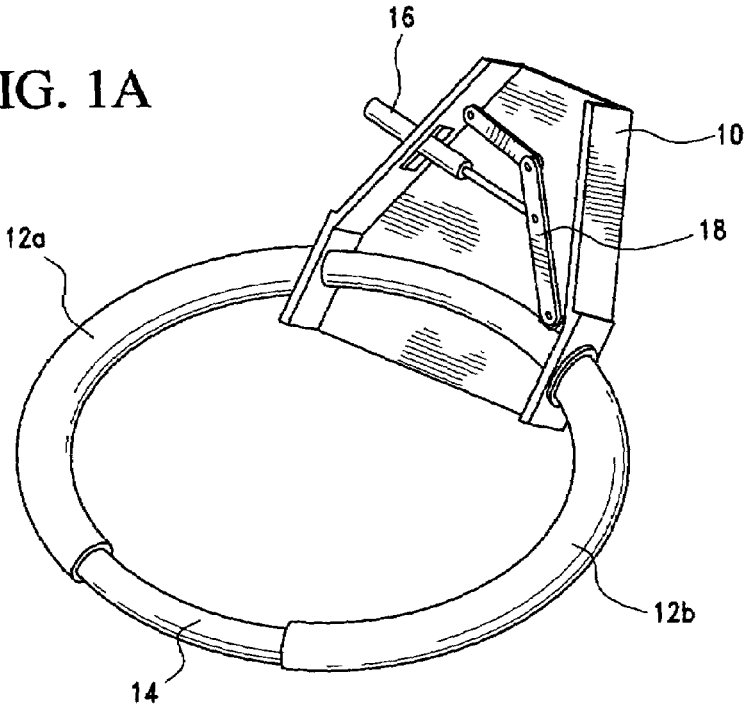
FIG. 1A is a perspective view of a tree limb folding apparatus according to the present invention shown in its closed configuration.
Figure 1B:
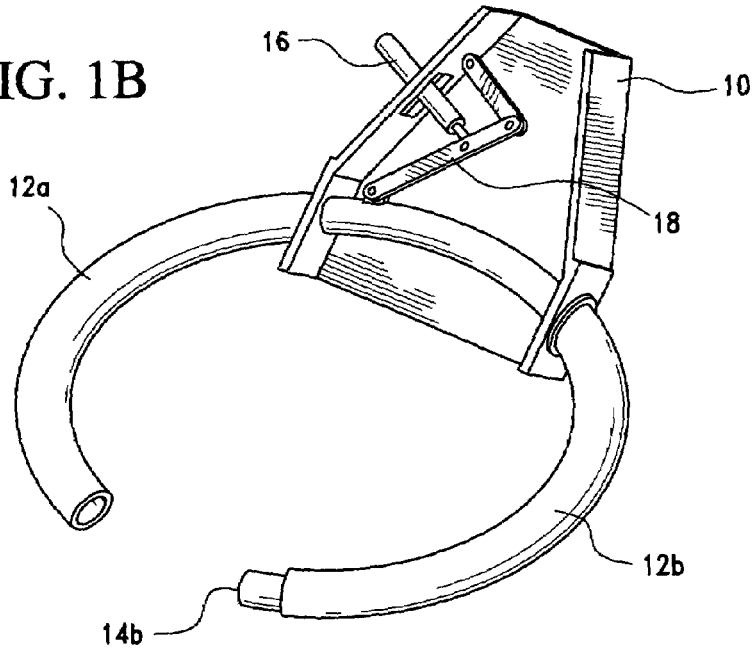
FIG. 1B is the apparatus of FIG. 1A in a configuration which is nearly completely open.

The apparatus comprises a base structure 10 which is adapted to be mounted to the elevatable portion of a lift truck or loader. Two hollow, arcuate tube sections 12*a* and 12*b* are fixedly mounted in circular orientation to opposite sides of the base structure 10. Passing through tube sections 12*a* and 12*b* is a part-circular slider tube 14 of smaller outer diameter than the internal diameter tube sections of 12*a* and 12*b*. An arc section of tube 14 has been removed to form a space between ends 14*a* and 14*b* which conforms to the fixed spacing between the front ends of arms 12*a* and 12*b*. Inner tube 14 can be rotated within the internal channel of 12*a* and 12*b* by a hydraulic piston 16 operatively connected to a lever arm 18 which is linked to the rear portion of inner tube 14. FIGS. 1A and 1B respectively show the device in its closed configuration and a configuration in which it is almost entirely open with end 14*b* of the inner about to be drawn fully into the interior of tube section 12*b*.

Between the inner surface of arms 12*a* and the outer surface of tube 14 are provided teflon or other bearings for smooth selective rotational motion under hydraulic control.

The fully opened space at the front of the tubes is typically contrived to be around 14–16 inches and the inner diameter between diametrically opposed points on the surface of the outer ring sections 12*a* and 12*b* is about 40–60 inches.

When the gap is opened, the apparatus can be horizontally advanced into position about a tree trunk below the branches, then the frame can be closed by actuation of the hydraulic piston 16. With the gap closed, a durable circular frame is formed for engaging and upwardly deflecting the limbs of a tree as a apparatus is elevated and allowing the folded branches to be baled.

I claim:

1. A tree limb apparatus, comprising:

a base structure for mounting to an elevatable support;

a generally annular tubular frame mounted rearwardly from said support and bounding a central area for accommodating the lower portion of a tree trunk, said frame having a forward gap for receiving said tree trunk when the apparatus is advanced towards a tree;

means for selectively opening and closing said forward gap, including (i) an internal channel through said tubular frame;

(ii) a part-circular slider tube seated within said channel for rotational movement therethrough, said slider tube having a space between remote ends thereof congruent with said forward gap of the frame; and (iii) hydraulic means for rotating the slider tube within the internal channel of the frame between a position in which said forward gap is open to receive said tree trunk into the central area of the frame and a position in which it is closed around said tree trunk received within the central area of the frame;

said generally annular tubular frame comprising two hollow arcuate tube sections fixedly mounted in circular orientation at opposite sides of said base structure; and said hydraulic means for rotating the slider tube comprising a hydraulic piston engaging said slider tube and operatively mounted to said base structure.

2. A tree limb apparatus, comprising:

a base structure for mounting to an elevatable support;

a generally annular tubular frame mounted rearwardly from said support and bounding a central area for accommodating the lower portion of a tree trunk, said frame having a forward gap for receiving said tree trunk when the apparatus is advanced towards a tree;

means for selectively opening and closing said forward gap, including (i) an internal channel through said tubular frame;

(ii) a part-circular slider tube seated within said channel for rotational movement therethrough, said slider tube having a space between remote ends thereof congruent with said forward gap of the frame; and (iii) means for rotating the slider tube within the internal channel of the frame between a position in which said forward gap is open to receive said tree trunk into the central area of the frame and a position in which it is closed around said tree trunk received within the central area of the frame;

said generally annular tubular frame comprising two hollow arcuate tube sections fixedly mounted in circular orientation at opposite sides of said base structure; and said means for rotating the slider tube comprising a hydraulic piston engaging said slider tube and operatively mounted to said base structure.

* * * * *